US009706797B1

(12) United States Patent
Kratsa

(10) Patent No.: US 9,706,797 B1
(45) Date of Patent: Jul. 18, 2017

(54) FABRIC TAPE BRASSIERE

(71) Applicant: Nina Kratsa, Los Angeles, CA (US)

(72) Inventor: Nina Kratsa, Los Angeles, CA (US)

( * ) Notice: Subject to any disclaimer, the term of this patent is extended or adjusted under 35 U.S.C. 154(b) by 0 days.

(21) Appl. No.: 15/225,192

(22) Filed: Aug. 1, 2016

(51) Int. Cl.
*A41C 3/06* (2006.01)
*A41C 3/00* (2006.01)

(52) U.S. Cl.
CPC ..... *A41C 3/065* (2013.01); *A41C 3/0028* (2013.01)

(58) Field of Classification Search
CPC ..... A41C 3/00; A41C 3/065; A41C 3/12
USPC ..... 450/81, 88, 54–57, 37
See application file for complete search history.

(56) References Cited

U.S. PATENT DOCUMENTS

| | | | | |
|---|---|---|---|---|
| 2,508,855 | A | 5/1950 | Brown | |
| 3,276,449 | A | 10/1966 | Morgan | |
| 3,934,593 | A | 1/1976 | Mellinger | |
| 4,343,313 | A | 8/1982 | Le Jeune | |
| 4,992,074 | A | 2/1991 | Diaz | |
| 5,998,693 | A | 12/1999 | Zagame | |
| 6,371,831 | B1 | 4/2002 | Dodge | |
| 6,383,055 | B2 * | 5/2002 | Valentin | 450/1 |
| 6,761,614 | B2 | 7/2004 | Pinna | |
| 7,335,086 | B1 * | 2/2008 | Karon | A41C 3/065 450/1 |
| 7,404,752 | B1 * | 7/2008 | Karon | A41C 3/12 2/53 |
| 7,993,182 | B2 | 8/2011 | Horton et al. | |
| 8,221,189 | B2 | 7/2012 | Chen et al. | |
| 8,936,504 | B2 | 1/2015 | Deal et al. | |
| 2002/0187727 | A1 * | 12/2002 | Pinna | A41C 3/065 450/81 |
| 2005/0059320 | A1 * | 3/2005 | Valentin | A41C 3/065 450/81 |
| 2005/0186885 | A1 * | 8/2005 | Valentin | A41C 3/065 450/81 |
| 2005/0221719 | A1 | 10/2005 | Chou | |
| 2010/0180359 | A1 | 7/2010 | Andrews | |
| 2012/0266348 | A1 | 10/2012 | Meginnis | |
| 2014/0057528 | A1 * | 2/2014 | Deal | A41C 3/065 450/38 |

* cited by examiner

*Primary Examiner* — Gloria Hale
(74) *Attorney, Agent, or Firm* — The Webb Law Firm

(57) ABSTRACT

A kit, for the construction of a single-use brassiere, including a first shaped form for removable-adhesion to a breast, and a second shaped form for at least partial adhesion to the first shaped form. At least a portion of the top surface of the first shaped form includes an overlap region for receiving a layering portion of the second shaped form thereover.

24 Claims, 6 Drawing Sheets

FABRIC TAPE BRASSIERE

BACKGROUND OF THE INVENTION

Field of the Invention

The present disclosure relates, in general, to a brassiere and, in particular, to a single-use brassiere made of fabric tape.

Description of Related Art

Conventional brassieres provide support to an individual's breasts by holding the individual's breasts in cups that are supported on the individual by straps around the individual's back and/or shoulder straps. Strapless dresses and some manner of summer wear cannot be worn with these brassieres since the support straps are often exposed out of the dresses or summer wear. Brassieres without straps have been designed, but are typically made from stiff, coarse fabrics that can be uncomfortable for an individual to wear. Further, brassieres are often provided in different sizes to accommodate different breast sizes and shapes for individuals. Conventional brassieres cannot be adjusted based on a change in the individual's breast size and shape.

Adhesive brassieres have been designed to address several of the disadvantages of conventional brassieres. Current adhesive brassieres, however, cannot be adjusted based on a change in the individual's breast size and shape. Current adhesive brassieres typically come in a single size according to the individual's current breast size and shape. The adhesive brassieres are adhesively attached to the individual's breast to cover a substantial portion of the individual's breast. Current adhesive brassieres typically do not provide support to the individual's breast. Further, adhesive brassieres typically only use a single nylon or silicone member to cover the individual's breast.

In view of the foregoing, a need exists for a brassiere that can be adjusted based on a change in an individual's breast size or shape. A further need exists for a brassiere that can be formed from multiple forms to shape to an individual's breast and support the individual's breast. A further need exists for a brassiere formed from multiple forms that may be stretched to position an individual's breast in a desired position.

SUMMARY OF THE INVENTION

Accordingly, and generally, breast support members and kits for the construction of a single-use brassiere are provided to address and/or overcome all of the deficiencies or drawbacks associated with existing brassieres.

In accordance with one aspect, a kit, for the construction of a single-use brassiere, may include a first shaped form for removable-adhesion to a breast including a first layer including an elastically deformable material having a top surface and a bottom surface, a second layer including an adhesive in contact with the bottom surface of the first layer, the adhesive having a first surface permanently adhered to the bottom surface of the first layer and a second surface, and a third layer including a removable release layer in removable contact with the second surface of the second layer; and a second shaped form for at least partial adhesion to the first shaped form, including a first layer including an elastically deformable material having a top surface and a bottom surface, a second layer including an adhesive in contact with the bottom surface of the first layer, the adhesive having a first surface permanently adhered to the bottom surface of the first layer and a second surface defining a layering portion, and a third layer including a removable release layer in removable contact with the second surface of the second layer. At least a portion of the top surface of the first shaped form includes an overlap region for receiving a layering portion of the second shaped form thereover.

A third shaped form may be provided for at least partial adhesion to at least one of the first shaped form and the second shaped form. The third shaped form may include a first layer including an elastically deformable material having a top surface and a bottom surface, a second layer including an adhesive in contact with the bottom surface of the first layer, the adhesive having a first surface permanently adhered to the bottom surface of the first layer and a second surface defining a layering portion, and a third layer including a removable release layer in removable contact with the second surface of the second layer. At least a portion of the top surface of at least one of the first shaped form and the second shaped form may include an overlap region for receiving a layering portion of the third shaped form thereover. The at least a portion of the top surface of the first shaped form and at least a portion of the top surface of the second shaped form may each include an overlap region for receiving a layering portion of the third shaped form thereover. The first shaped form and the second shaped form may be differently shaped. The first layer of the first shaped form and the first layer of the second shaped form may be fabric-based. The adhesive of the second layer of the first shaped form and the adhesive of the second layer of the second shaped form may be an acrylic adhesive. The first shaped form and the second shaped form may include elastic therapeutic tape. The first shaped form and the second shaped form may each have an undeformed length in the longitudinal direction and an elastically deformed length in the longitudinal direction of from 20% to 50% the undeformed length. The layering portion of the second shaped form may overlap the overlap region of the first shaped form an overlap length of between 10% and 80% of an overall length of the second shaped form. The layering portion of the second shaped form may overlap the overlap region of the first shaped form an overlap length of between 20% and 50% of an overall undeformed length of the second shaped form. At least one of the first shaped form and the second shaped form may include an application region for being grasped by a user during adhesion to the breast. The first shaped form may include an asymmetric curvature profile having a first securement end for attachment above a portion of the breast and a second securement end for attachment below and/or onto a portion of the breast. The second shaped form may include a symmetric curvature profile having a first securement end for attachment to a side of a first breast and a second securement end for attachment to a side of a second breast. The top surface of at least one of the first shaped form and the second shaped form may include an ornamental enhancement disposed thereon or therewith. At least one trim line may be disposed on a surface of at least one of the first shaped form and the second shaped form. The trim line may provide an indication to a user of a trimmable size of the shaped form. At least one nipple cover may be configured for placement underneath at least one of the forms when formed on an individual's breast. A support layer may be configured for placement underneath at least one of the forms when formed on an individual's breast.

In another aspect of the disclosure, a breast support element for a single-use brassiere may include a shaped form for removable-adhesion to a breast including a first layer including an elastically deformable material having a top surface and a bottom surface, a second layer including an adhesive in contact with the bottom surface of the first layer, the adhesive having a first surface permanently adhered to the bottom surface of the first layer and a second surface, and a third layer including a removable release layer in removable contact with the second surface of the second layer. The top surface of the first layer may define an overlap region demarcated thereon for indication to a user of the positioning of a second shaped form thereover.

The demarcation of the overlap region may be printed on the top surface of the first layer. The first layer may be fabric-based and the adhesive of the second layer may include an acrylic adhesive. The shaped form may include an elastic therapeutic tape.

In another aspect of the disclosure, a breast support element for a single-use brassiere may include a shaped form for removable-adhesion to a breast including a first layer including an elastically deformable material having a top surface and a bottom surface, a second layer including an adhesive in contact with the bottom surface of the first layer, the adhesive having a first surface permanently adhered to the bottom surface of the first layer and a second surface, and a third layer including a removable release layer in removable contact with the second surface of the second layer. At least one of the second layer and the third layer may define a layering portion demarcated thereon for indication to a user of positioning the shaped form at least partially over a base form.

The demarcation of the layering portion may be printed on at least one of the bottom surface of the first layer and the removable release layer. The shaped form may include an elastic therapeutic tape.

These and other features and characteristics of the brassiere and breast support members, as well as the methods of forming the brassiere, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DESCRIPTION OF THE DISCLOSURE

Figure 1A:
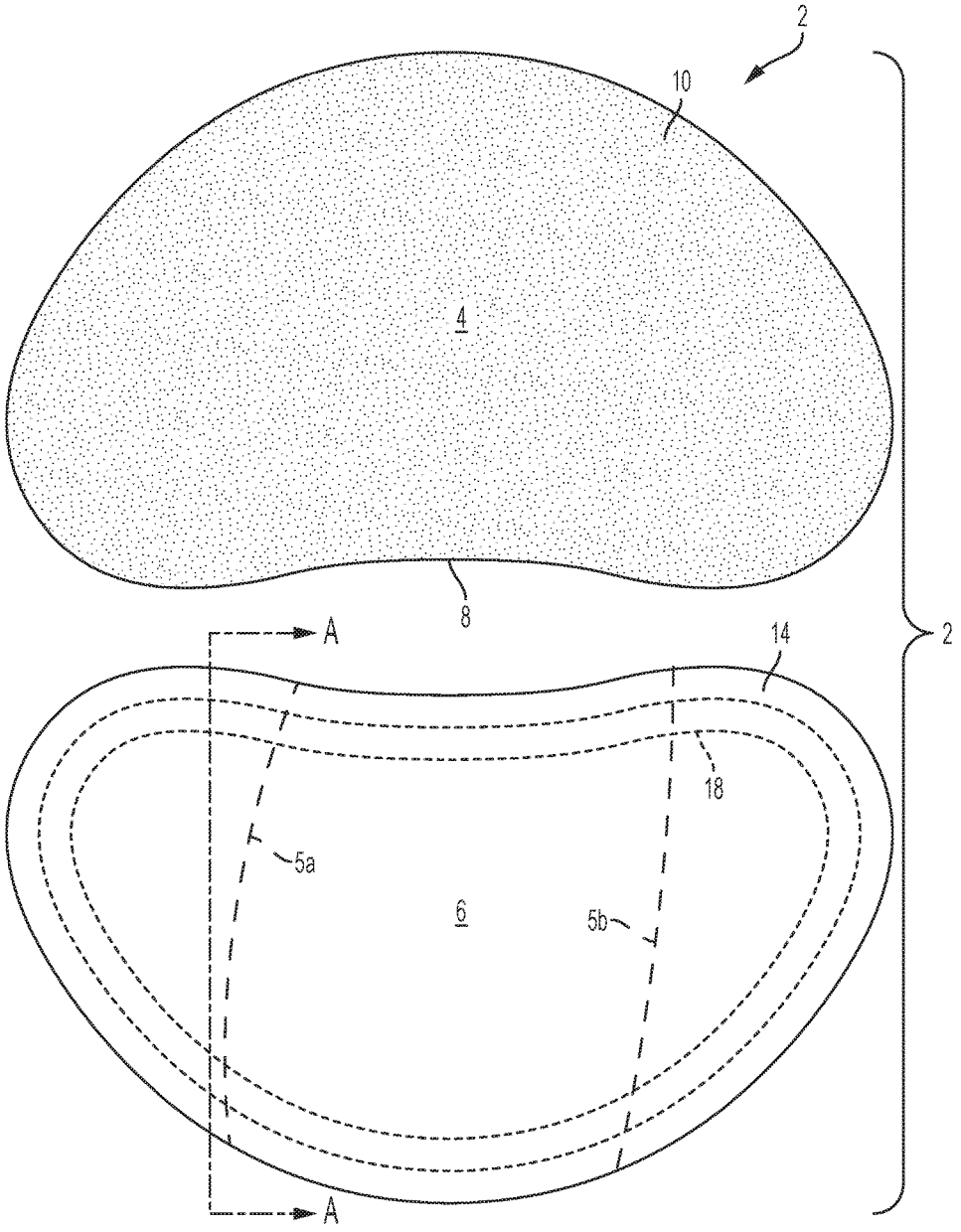
FIG. 1A is a front and rear view of a breast support member according to one aspect of the present disclosure.

For purposes of the description hereinafter, the terms "upper", "lower", "right", "left", "vertical", "horizontal", "top", "bottom", "lateral", "longitudinal", and derivatives thereof shall relate to the invention as it is oriented in the drawings. However, it is to be understood that the invention may assume alternative variations and step sequences, except where expressly specified to the contrary. It is also to be understood that the specific brassieres, breast support members, and methods of applying such illustrated in the attached drawings, and described in the following specification, are simply exemplary aspects of the disclosure. Hence, specific dimensions and other physical characteristics related to the aspects disclosed herein are not to be considered as limiting.

The present disclosure is directed to, in general, a brassiere and, in particular, to a single-use brassiere made of fabric tape. Certain preferred and non-limiting aspects of the brassiere are illustrated in FIGS. 1-9.

With reference to FIG. 1A, a breast support member 2 (which may also be referred to as a form) according to one aspect of the disclosure is described. The breast support member 2 may include a front surface 4 and a rear surface 6. During use of the breast support member 2, the rear surface 6 may be adhesively attached to an individual's breast. The breast support member 2 may have a generally oval shape, with a recessed region 8. In one aspect, the breast support member 2 may have an asymmetric curvature profile. The breast support member 2 may be configured to cover a lower half of an individual's breast, as will be described in greater detail below.

The breast support member 2 may be made of a fabric-based material. In one aspect, the breast support member 2 may be made of an elastic therapeutic tape. One example of such an elastic therapeutic tape is Kinesio® tape. By using an elastic therapeutic tape for the breast support member 2, an individual can stretch the breast support member 2 to cover a desired amount of the individual's breast. In one aspect, the breast support member 2 may have an undeformed length in a longitudinal direction and an elastically deformed length in the longitudinal direction of approximately 20% to 50% of the undeformed length.

Figure 2:
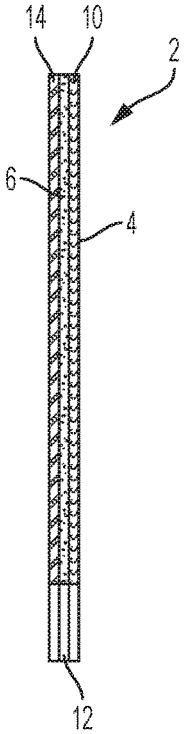
FIG. 2 is a cross-sectional view of the breast support member of FIG. 1A shown along line A-A.

With reference to FIG. 2, the breast support member 2 may include three layers 10, 12, 14. A first layer 10 may be provided on a front portion of the breast support member 2. The first layer 10 may include the front surface 4 of the breast support member 2. In one configuration, the first layer 10 may have an overall coloration to match a variety of skin tones. The front surface of the first layer 10 may have a generally matte appearance so as to blend with the user's skin. The front surface of the first layer 10, which corresponds to the front surface 4, may have an ornamental enhancement disposed thereon or therewith. Example ornamental enhancements include solid colors, patterns, lace, glitter, rhinestones, and various animal prints, such as leopard, tiger, zebra, snake, alligator and crocodile prints. The first layer 10 may be made of an elastically deformable material, such as an elastic therapeutic tape. The second layer 12 may be provided behind the first layer 10, such that a rear surface of the first layer 10 is in contact with a front surface of the second layer 12. The second layer 12 may include an adhesive in contact with the rear surface of the first layer 10. In one aspect, the adhesive may be an acrylic adhesive. The adhesive of the second layer 2 is configured to allow the breast support member 2 to be removably attached to an individual's breast. The third layer 14 may be a removable release layer that is in removable contact with the second layer 12. In one aspect, a front surface of the third layer 14 may be adhesively, removably attached to a rear surface of the second layer 12. During use of the breast support member 2, the third layer 14 may be removed from the second layer 12 by an individual to expose the adhesive second layer 12 to allow for adhesion of the breast support member 2 to the individual's breast.

With reference to FIG. 1A, at least one demarcation line 5*a*, 5*b* may be demarcated on a rear surface of the breast support member 2 to indicate to an individual an overlap region 48 (shown in FIG. 8B) of the breast support member 2 over another breast support member 20. The demarcation lines 5*a*, 5*b* may indicate to the individual where the breast support member 2 should be removably adhered on the underlying breast support member 20 to form the brassiere on the individual's breasts. The demarcation lines 5*a*, 5*b* may be demarcated on at least one of the second and third layers 12, 14 of the breast support member 2.

Figure 1B:
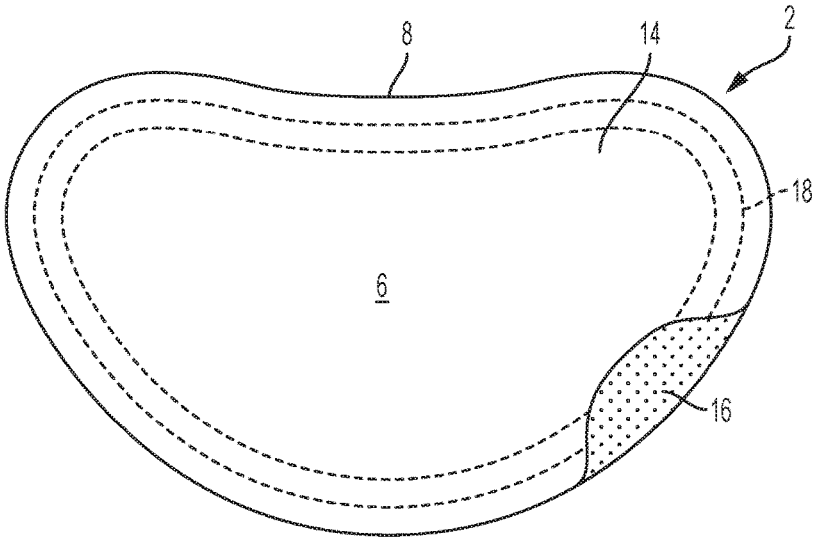
FIG. 1B is a rear view of the breast support member of FIG. 1A with an application zone.

With reference to FIG. 1B, the breast support member 2 may also include an application region 16 on the rear surface 6. The application region 16 is configured to be grasped by an individual during application of the breast support member 2 on the individual's breast. The application region 16 may be provided on the rear surface of the second layer 12 of the breast support member 2. Therefore, after the third layer 14 has been stripped away from the second layer 12, the individual may grasp the application region 16, which may be non-adhesive, to adhere the breast support member 2 to the individual's breast. Since the application region 16 is non-adhesive, the application region 16 will not adhere to the individual's fingers when applying the breast support member 2 to the individual's breast, thereby avoiding having adhesive stick to the individual's fingers. As shown in FIGS. 1A and 1B, the rear surface of the third layer 14 may have at least one trim line 18 to provide an indication to an individual of a trimmable size of the shaped form of the breast support member 2. Therefore, based on the size and shape of the individual's breast, the individual may trim the breast support member 2 along one of the trim lines 18 to adapt the breast support member 2 to the desired size, while retaining the outer profile of the breast support member 2.

Figure 1C:
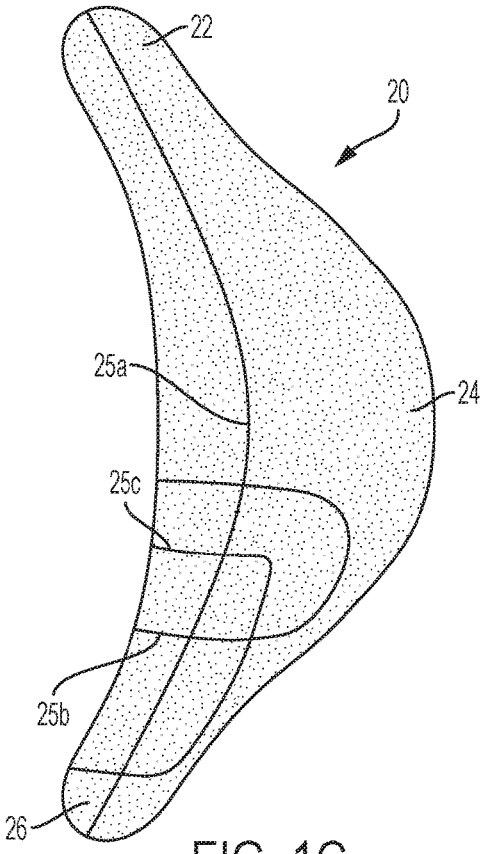
FIG. 1C is a front view of another breast support member according to another aspect of the present disclosure.

With reference to FIG. 1C, another aspect of a breast support member 20 (which may also be referred to as a form) is described. The breast support member 20 may include a first securement end 22, a middle portion 24, and a second securement end 26. The first securement end 22 may be configured to adhere to an upper portion of an individual's breast, and the second securement end 26 may be configured to adhere to a lower portion of an individual's breast. The middle portion 24 may have an enlarged diameter in comparison to the first securement end 22 and the second securement end 26. In one aspect, the breast support member 20 may have an asymmetric curvature profile. The application of the breast support member 20 to an individual's breast is described in greater detail below. The breast support member 20 may be made of a fabric-based material. In one aspect, the breast support member 20 may be made of an elastic therapeutic tape. One example of such an elastic therapeutic tape is Kinesio® tape. By using an elastic therapeutic tape for the breast support member 20, an individual can stretch the breast support member 20 to cover a desired amount of the individual's breast. In one aspect, the breast support member 20 may have an undeformed length in a longitudinal direction and an elastically deformed length in the longitudinal direction of approximately 20% to 50% of the undeformed length.

As described above in relation with the breast support member 2, the breast support member 20 may have a similar layer construction as the breast support member 2. Although not shown in relation to the breast support member 20, the breast support member 20 may include at least three layers including a first layer, a second layer, and a third layer. The first layer may be made of an elastically deformable material, such as an elastic therapeutic tape. The second layer may be provided behind the first layer, such that a rear surface of the first layer is in contact with a front surface of the second layer. The second layer may include an adhesive in contact with the rear surface of the first layer. In one aspect, the adhesive may be an acrylic adhesive. The adhesive of the second layer is configured to allow the breast support member to be removably attached to an individual's breast. The third layer may be a removable release layer that is in removable contact with the second layer. In one aspect, a front surface of the third layer may be adhesively, removably attached to a rear surface of the second layer. During use of the breast support member 20, the third layer may be removed from the second layer by an individual to expose the adhesive second layer to allow for adhesion of the breast support member 20 to the individual's breast. The breast support member 20 may also include an application region (not shown) to assist an individual in adhering the breast support member 20 to the individual's breast. Similar to the breast support member 2, the breast support member 20 may include at least one trim line to assist an individual in reshaping and/or resizing the breast support member 20 to fit to his/her breast.

The breast support member 20 may also include at least one demarcation line 25*a*-25*c* provided on the front surface to indicate to an individual the positioning of a second breast support member on top of the breast support member 20 (described in greater detail below). A first demarcation line 25*a* may demarcate an overlap region 42 (shown in FIG. 5B) of a second breast support member 20' that is placed over at least a portion of a first breast support member 20. The demarcation line 25*a* may indicate to an individual where the second breast support member 20' should be placed over the first breast support member 20 for forming the brassiere on the individual. A second demarcation line 25*b* may demarcate an overlap region 46 (shown in FIG. 7B) of a second breast support member 28 that is placed over at least a portion of a first breast support member 20. The demarcation line 25*b* may indicate to an individual where the second breast support member 28 should be placed over the first breast support member 20 for forming a brassiere on the individual. A third demarcation line 25*c* may demarcate an overlap region 48 (shown in FIG. 8B) of a second breast support member 2 that is placed over at least a portion of a first breast support member 20. The demarcation line 25*c* may indicate to an individual where the second breast support member 2 should be placed over the first breast support member 20 for forming the brassiere on the individual.

Figure 6:
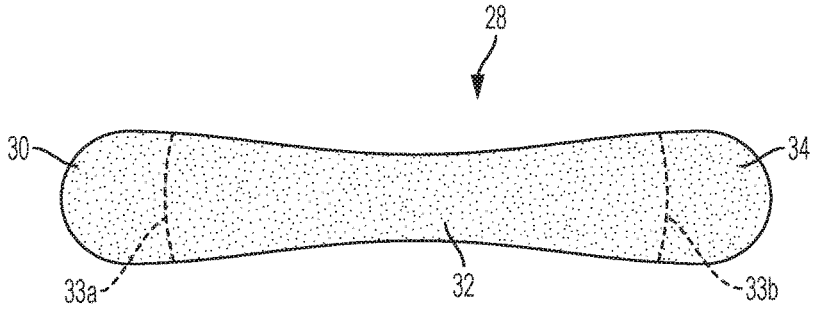
FIG. 6 is a front view of another breast support member according to another aspect of the present disclosure.

With reference to FIG. 6, another aspect of a breast support member 28 (which may also be referred to as a form) is described. The breast support member 28 may include a first securement end 30, a middle portion 32, and a second securement end 34. The breast support member 28 may be configured to bring together an individual's breasts to increase the individual's cleavage. The first securement end 30 may adhere to an outer side of a first breast and the second securement end 34 may adhere to an outer side of a second breast. A method of adhering the breast support member 28 to an individual's breast is described in greater detail below. In one aspect, the breast support member 28 may have a symmetric curvature profile. The breast support member 28 may be made of a fabric-based material. In one aspect, the breast support member 28 may be made of an elastic therapeutic tape. One example of such an elastic therapeutic tape is Kinesio® tape. By using an elastic therapeutic tape for the breast support member 28, an individual can stretch the breast support member 28 to cover a desired amount of the individual's breast. In one aspect, the breast support member 28 may have an undeformed length in a longitudinal direction and an elastically deformed length in the longitudinal direction of approximately 20% to 50% of the undeformed length.

As described above in relation with the breast support member 2, the breast support member 28 may have a similar layer construction as the breast support member 2. Although not shown in relation to the breast support member 28, the breast support member 28 may include at least three layers including a first layer, a second layer, and a third layer. The first layer may be made of an elastically deformable material, such as an elastic therapeutic tape. The second layer may be provided behind the first layer, such that a rear surface of the first layer is in contact with a front surface of the second layer. The second layer may include an adhesive in contact with the rear surface of the first layer. In one aspect, the adhesive may be an acrylic adhesive. The adhesive of the second layer is configured to allow the breast support member to be removably attached to an individual's breast. The third layer may be a removable release layer that is in removable contact with the second layer. In one aspect, a front surface of the third layer may be adhesively, removably attached to a rear surface of the second layer. During use of the breast support member 28, the third layer may be removed from the second layer by an individual to expose the adhesive second layer to allow for adhesion of the breast support member 28 to the individual's breast. The breast support member 28 may also include an application region (not shown) to assist an individual in adhering the breast support member 28 to the individual's breast. Similar to the breast support member 2, the breast support member 28 may include at least one trim line to assist an individual in reshaping and/or resizing the breast support member 28 to fit to his/her breast. At least one demarcation line 33*a*, 33*b* may be demarcated on a rear surface of the breast support member 28 to indicate to an individual an overlap region 46 (shown in FIG. 7B) of the breast support member 28 over another breast support member 20. The demarcation lines 33*a*, 33*b* may indicate to the individual where the breast support member 28 should be removably adhered on the underlying breast support member 20 to form the brassiere on the individual's breasts. The demarcation lines 33*a*, 33*b* may be demarcated on at least one of the second and third layers of the breast support member 28.

Figure 3A:
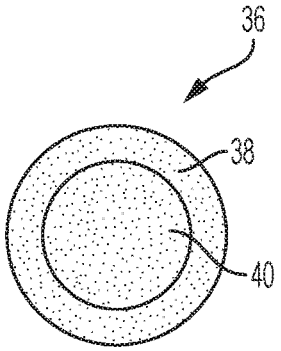
FIG. 3A is a top view of a nipple cover according to one aspect of the present disclosure.
Figure 3B:
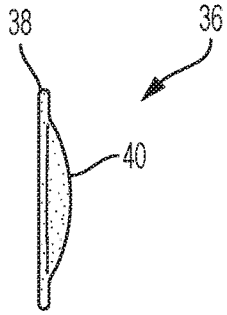
FIG. 3B is a side view of the nipple cover of FIG. 3A.

With reference to FIGS. 3A and 3B, a nipple cover 36 is described. The nipple cover 36 may include a base 38 and a cover member 40. The base 38 may be configured to fit around an individual's nipple so the cover member 40 can protect the individual's nipple from irritation or contact with the adhesive layer on a breast support member 2, 20, 28 or the individual's clothing. The cover member 40 may extend from the base 38. The nipple cover 36 may have a substantially circular shape. In one aspect, the nipple cover 36 may be non-adhesively positioned over an individual's nipples. In another aspect, the base 38 of the nipple cover 36 may be adhesively, removably attached to a skin surface around the individual's nipple. The nipple cover 36 may be made of fabric, silicone, or gauze. It is to be understood, however, that any type of material may be used for the nipple cover 36 such that the material prevents irritation of the individual's nipple.

Figure 4:
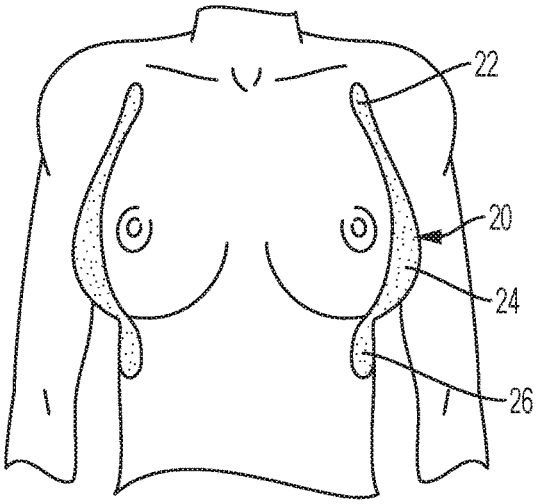
FIG. 4 is a front view of an individual with the breast support members of FIG. 1C applied to his/her breasts.
Figure 5A:
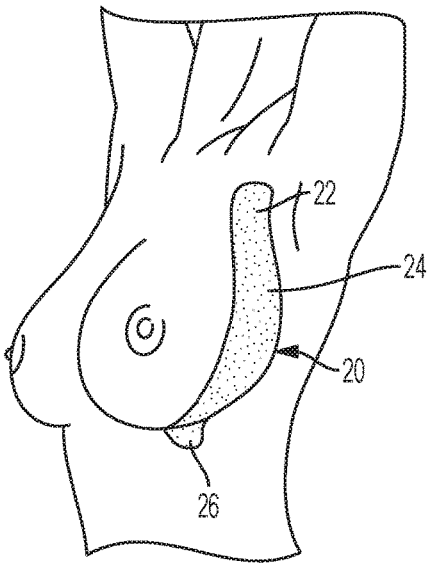
FIG. 5A is a side perspective view of an individual with one breast support member shown in FIG. 1C provided on his/her breast.
Figure 5B:
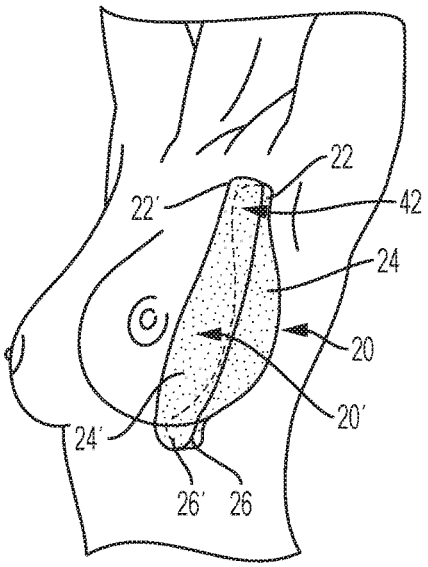
FIG. 5B is a side perspective view of the individual of FIG. 5A with two breast support members shown in FIG. 1C provided on his/her breast.
Figure 5C:
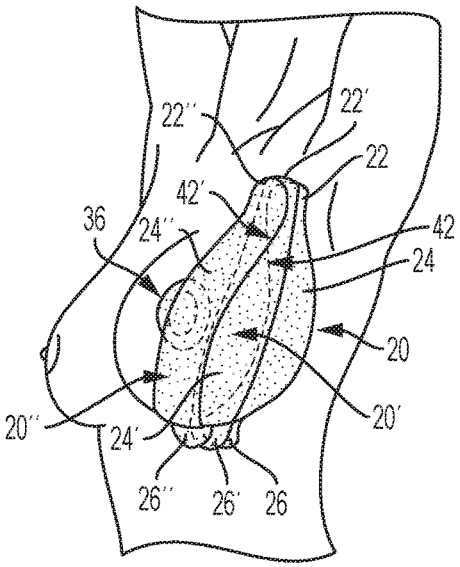
FIG. 5C is a side perspective view of the individual of FIG. 5A with two breast support members shown in FIG. 1C and a nipple cover shown in FIG. 3A provided on his/her breast.

With reference to FIGS. 4-5C, a method of forming a fabric tape brassiere on an individual's breast is described. The fabric tape brassiere may be formed on an individual's breast using a kit including at least one breast support member 20. In another aspect, at least two breast support members 20 may be provided in the kit to form the fabric tape brassiere. To expose the adhesive on the second layer of the first breast support member 20, the third layer is removed from the back of the first breast support member 20. When forming the brassiere on the individual's breast, the second securement end 26 may be removably adhered to the individual's skin on an outer side of and underneath the individual's breast. After the second securement end 26 has been adhered to the individual's skin, the first breast support member 20 may be pulled upwardly by grasping the first securement end 22. By pulling the first breast support member 20 upwards, the individual's breast can be lifted to a desired position. The individual may also pull the first breast support member 20 inwardly to create cleavage for the individual's breasts. After the individual has moved his/her breast into the desired position, the first securement end 22 may be removably adhered to the individual's skin above the individual's breast. The middle portion 24 may also be pressed onto the individual's skin to removably adhere the middle portion 24 to the individual's breast. The middle portion 24 is configured to support the side of the individual's breast. As shown in FIG. 4, a first breast support member 20 may be applied to each of the individual's breasts.

As shown in FIG. 5B, after the first breast support member 20 has been applied to the individual's breast, a second breast support member 20' may be removably adhered to the individual's breast to further form the brassiere. The second breast support member 20' may be partially positioned over top of the first breast support member 20 such that a layering portion of the second breast support member 20' over the first breast support member 20 forms an overlap region 42 between the two breast support members 20, 20'. In one aspect, the layering portion of the second breast support portion 20' may form an overlap region having an overlap length of between 10% and 80% of an overall length of the second breast support member 20'. In another aspect, the overlap length may be between 20% and 50% of an overall length of the second breast support member 20'. It is also contemplated that the layering portion of the second breast support portion 20' may form an overlap region having an overlap length of the entire overall length of the second breast support member 20'. The second breast support member 20' may be positioned on an inner portion of the individual's breast in comparison to the position of the first breast support member 20.

To expose the adhesive on the second layer of the second breast support member 20', the third layer is removed from the back of the second breast support member 20'. When forming the brassiere on the individual's breast, the second securement end 26' may be removably adhered to the individual's skin underneath the individual's breast. After the second securement end 26' has been adhered to the individual's skin, the second breast support member 20' may be pulled upwardly by grasping the first securement end 22'. By pulling the second breast support member 20' upwards, the individual's breast can be further lifted to a desired position. The individual may also pull the second breast support member 20' inwardly to create cleavage for the individual's breasts. After the individual has moved his/her breast into the desired position, the first securement end 22' may be removably adhered to the individual's skin above the individual's breast. The middle portion 24' may also be pressed onto the individual's skin to removably adhere the middle portion 24' to the individual's breast. At least a portion of the second breast support member 20' may be removably adhered to the individual's breast and at least a portion of the second breast support member 20' may be removably adhered to the first support member 20 to form the overlap region 42.

As shown in FIG. 5C, a third breast support member 20" may be removably adhered to the individual's breast to further form the brassiere. The third breast support member 20" may be partially positioned over top of the second breast support member 20' such that a layering portion of the third breast support member 20" over the second breast support member 20' forms an overlap region 42' between the two breast support members 20', 20". In one aspect, the layering portion of the third breast support portion 20" may form an overlap region having an overlap length of between 10% and 80% of an overall length of the third breast support member 20". In another aspect, the overlap length may be between 20% and 50% of an overall length of the third breast support member 20". It is also contemplated that the layering portion of the third breast support portion 20" may form an overlap region having an overlap length of the entire overall length of the third breast support member 20". The third breast support member 20" may be positioned on an inner portion of the individual's breast in comparison to the position of the second breast support member 20'.

To expose the adhesive on the second layer of the third breast support member 20", the third layer is removed from the back of the third breast support member 20". When forming the brassiere on the individual's breast, the second securement end 26" may be removably adhered to the individual's skin underneath the individual's breast. After the second securement end 26" has been adhered to the individual's skin, the third breast support member 20" may be pulled upwardly by grasping the first securement end 22". By pulling the third breast support member 20" upwards, the individual's breast can be further lifted to a desired position. The individual may also pull the third breast support member 20" inwardly to create cleavage for the individual's breasts. After the individual has moved his/her breast into the desired position, the first securement end 22" may be removably adhered to the individual's skin above the individual's breast. The middle portion 24" may also be pressed onto the individual's skin to removably adhere the middle portion 24" to the individual's breast. At least a portion of the third breast support member 20" may be removably adhered to the individual's breast and at least a portion of the third breast support member 20" may be removably adhered to the second support member 20' to form the overlap region 42'.

As shown in FIG. 5C, the brassiere may also be formed on the individual's breast using a nipple cover 36. Before securing the third breast support member 20" to the individual's breast, the nipple cover 36 may be positioned over the individual's nipple. The individual may hold the nipple cover 36 over his/her nipple while pulling the third breast support member 20" up' and over the nipple cover 36 to secure the nipple cover 36 over the individual's nipple. The adhesive on the third layer of the third breast support member 20" may adhere to the nipple cover 36, thereby securing the nipple cover 36 over the individual's nipple. It is also contemplated that the nipple cover 36 may be removably adhered to a portion of the individual's skin around the individual's nipple before removably adhering the third breast support member 20" to the individual's breast. In this aspect, the nipple cover 36 is secured to the individual's breast without the need for the third breast support member 20".

Figure 9:
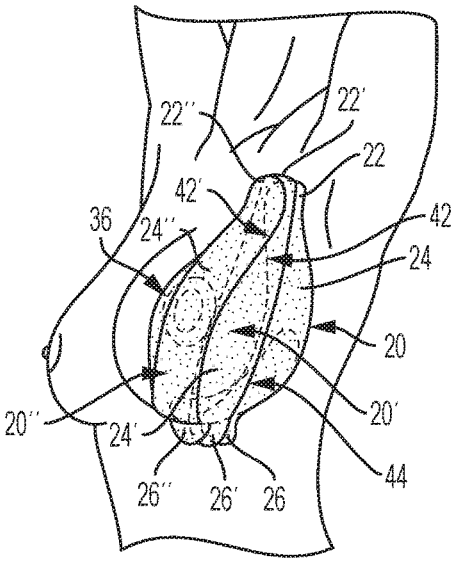
FIG. 9 is a side perspective view of an individual with a plurality of breast support members shown in FIG. 1C provided on his/her breast, a nipple cover shown in FIG. 3A, and a non-adhesive pad.

As shown in FIG. 9, an additional support layer 44 may be positioned underneath the breast support members 20, 20', 20" to provide additional support to the individual's breast when using the brassiere. The support layer 44 may not be removably adhered to the individual's skin, but may be held in position underneath the individual's breast by the breast support members 20, 20', 20". The support layer 44 may be formed under the breast support members 20, 20', 20" by the individual holding the support layer 44 in position on the individual's breast as each breast support member 20, 20', 20" is removably adhered to the individual's breast. It is contemplated that more than one support layer 44 may be formed with the brassiere depending on the support needed for the individual's breast.

Figure 7A:
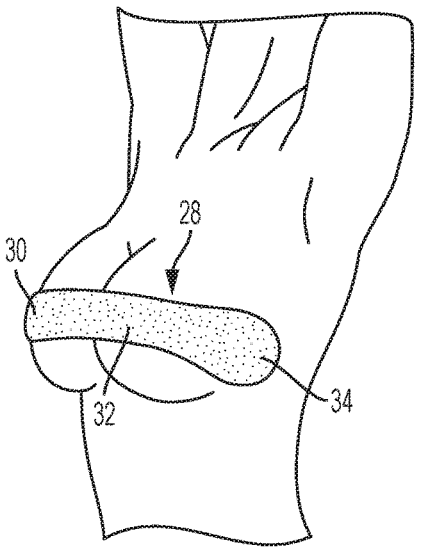
FIG. 7A is a side perspective view of an individual with a breast support member shown in FIG. 6 provided across his/her breasts.

With reference to FIG. 7A, a brassiere may also be formed using the breast support member 28. The breast support member 28 may be used primarily to form cleavage with the individual's breasts. To expose the adhesive on the second layer of the breast support member 28, the third layer is removed from the back of the breast support member 28. When forming the brassiere on the individual's breast, the first or second securement end 30, 34 may be removably adhered to the individual's skin on an outer side of the individual's breast. After the first or second securement end 30, 34 has been adhered to the individual's skin, the breast support member 28 may be pulled across the individual's chest by grasping the opposing securement end 30, 34. By pulling the breast support member 28 across the individual's chest, the individual's breasts can be pushed together to form cleavage between the individual's breasts. After the individual has moved his/her breasts into the desired position, the opposing securement end 30, 34 may be removably adhered to the individual's skin on an outer side of the individual's opposing breast. The middle portion 32 may also be pressed onto the individual's skin to removably adhere the middle portion 32 to the individual's breasts. It is also contemplated that more than one breast support member 28 may be used on the individual's breasts to position the individual's breasts in a desired position.

Figure 7B:
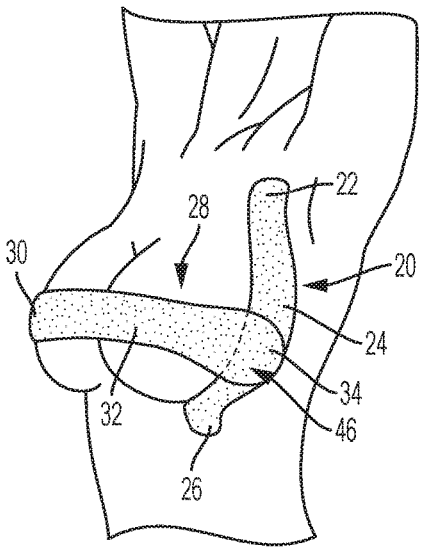
FIG. 7B is a side perspective view of an individual with a breast support member shown in FIG. 6 provided across his/her breasts and a breast support member shown in FIG. 1C provided on the side of his/her breasts.

As shown in FIG. 7B, a breast support member 20 may be used with the breast support member 28 to form a brassiere on the individual's breasts. A kit may be provided with at least one breast support member 20 and at least one breast support member 28 to form the brassiere on each of the individual's breasts. In a similar manner described above in regards to the breast support member 20, the breast support member 20 may be removably adhered to the individual's breast. The breast support member 20 may be used to lift the individual's breast. At least one breast support member 20 may be removably adhered to the side of each of the individual's breasts. After the breast support members 20 have been applied to the individual's breasts, one of the securement ends 30, 34 of the breast support member 28 may be removably adhered to one of the breast support members 20. The breast support member 28 and the breast support member 20 may be adhered to one another in an overlap region 46. The individual may then pull the opposing securement end 30, 34 across the individual's chest to secure the opposing securement end 30, 34 to the opposing breast support member 20. The breast support member 28 may push the individual's breasts together to form cleavage with the individual's breasts. It is also contemplated that a nipple cover 36 may be used with the breast support members 20, 28.

Figure 8A:
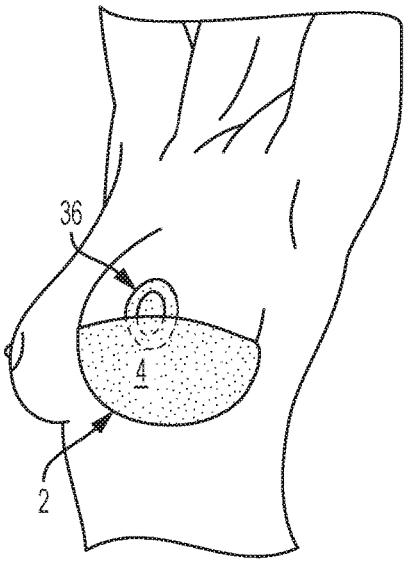
FIG. 8A is a side perspective view of an individual with a breast support member shown in FIG. 1A provided on his/her breast.

With reference to FIG. 8A, a brassiere may also be formed using the breast support member 2. The third layer 14 of the breast support member 2 may be removed to permit the individual to apply the breast support member 2 on the individual's breast using the adhesive on the second layer 12. The individual may removably adhere a lower portion of the breast support member 2 underneath the individual's breast. The individual may then pull an upper portion of the breast support member 2 upwards to lift the individual's breast. The upper portion of the breast support member 2 may then be removably adhered to a middle portion of the individual's breast to form the brassiere. It is also contemplated that a nipple cover 36 may be used to protect the individual's nipple from the adhesive on the rear surface 6 of the breast support member 2.

Figure 8B:
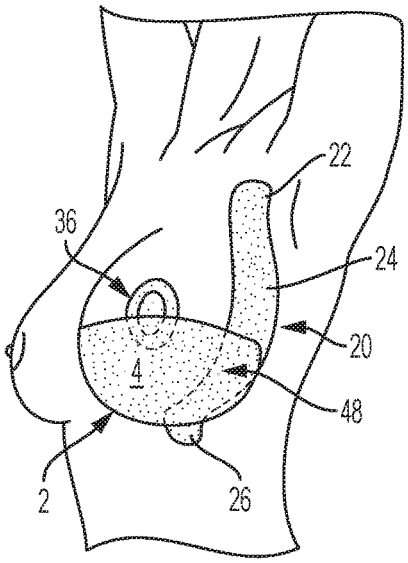
FIG. 8B is a side perspective view of an individual with a breast support member shown in FIG. 1A provided on his/her breast and a breast support member shown in FIG. 1C provided on the side of his/her breasts.

With reference to FIG. 8B, a brassiere may be formed using the breast support member 2 and the breast support member 20. A kit may be provided with at least one breast support member 2 and at least one breast support member 20 to form a brassiere on each of the individual's breasts. In a similar manner described above in regards to the breast support member 20, the breast support member 20 may be removably adhered to the individual's breast. The breast support member 20 may be used to lift the individual's breast. At least one breast support member 20 may be removably adhered to the side of each of the individual's breasts. After the breast support members 20 have been applied to the individual's breasts, a lower portion of the breast support member 2 may be removably adhered to the individual's skin underneath the individual's breasts. The breast support members 2 may then be pulled upwards to lift the individual's breasts and removably adhered to a middle portion of the individual's breasts. A portion of the breast support member 2 may be removably adhered to a portion of the breast support member 20 in an overlap region 48. It is also contemplated that a nipple cover 36 may be used to protect the individual's nipple from the adhesive on the rear surface 6 of the breast support member 2.

It is further contemplated herein that a similar overlapping support assembly could be used to provide a lifting appearance to a user's buttocks. In this configuration, a buttocks support member, as similarly described above with reference to the breast support member 20, may be applied to a portion of the user's buttocks to lift a portion thereof. A second buttocks support member may be provided in an overlapping fashion, as similarly described above, to provide further support and achieve adequate lift.

While various aspects of a fabric tape brassiere and breast support member were provided in the foregoing description, those skilled in the art may make modifications and alterations to these aspects without departing from the scope and spirit of the disclosure. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims and all changes to the invention that fall within the meaning and the range of equivalency of the claims are to be embraced within their scope.

What is claimed is:

1. A kit, for the construction of a single-use brassiere, comprising:

a first shaped form for removable-adhesion to a breast comprising a first layer comprising an elastically deformable material having a top surface and a bottom surface, a second layer comprising an adhesive in contact with the bottom surface of the first layer, the adhesive having a first surface permanently adhered to the bottom surface of the first layer and a second surface, and a third layer comprising a removable release layer in removable contact with the second surface of the second layer, the first shaped form comprising an elastic therapeutic tape; and a second shaped form for at least partial adhesion to the first shaped form, comprising a first layer comprising an elastically deformable material having a top surface and a bottom surface, a second layer comprising an adhesive in contact with the bottom surface of the first layer, the adhesive having a first surface permanently adhered to the bottom surface of the first layer and a second surface defining a layering portion, and a third layer comprising a removable release layer in removable contact with the second surface of the second layer, the second shaped form comprising an elastic therapeutic tape;

wherein at least a portion of the top surface of the first shaped form includes an overlap region for receiving a layering portion of the second shaped form thereover to form a brassiere.

2. The kit of claim 1, further comprising a third shaped form for at least partial adhesion to at least one of the first shaped form and the second shaped form, the third shaped form comprising a first layer comprising an elastically deformable material having a top surface and a bottom surface, a second layer comprising an adhesive in contact with the bottom surface of the first layer, the adhesive having a first surface permanently adhered to the bottom surface of the first layer and a second surface defining a layering portion, and a third layer comprising a removable release layer in removable contact with the second surface of the second layer, wherein the at least a portion of the top surface of at least one of the first shaped form and the second shaped form include an overlap region for receiving a layering portion of the third shaped form thereover.

3. The kit of claim 2, wherein the at least a portion of the top surface of the first shaped form and at least a portion of the top surface of the second shaped form each include an overlap region for receiving a layering portion of the third shaped form thereover.

4. The kit of claim 1, wherein the first shaped form and the second shaped form are differently shaped.

5. The kit of claim 1, wherein the first layer of the first shaped form and the first layer of the second shaped form are fabric-based.

6. The kit of claim 1, wherein the adhesive of the second layer of the first shaped form and the adhesive of the second layer of the second shaped form is an acrylic adhesive.

7. The kit of claim 1, wherein the first shaped form and the second shaped form each have an undeformed length in the longitudinal direction from a first end to a second end and an elastically deformed length in the longitudinal direction from the first end to the second end of 20% to 50% the undeformed length.

8. The kit of claim 1, wherein the layering portion of the second shaped form overlaps the overlap region of the first shaped form an overlap length of between 10% and 80% of an overall length of the second shaped form.

9. The kit of claim 1, wherein the layering portion of the second shaped form overlaps the overlap region of the first shaped form an overlap length of between 20% and 50% of an overall undeformed length of the second shaped form.

10. The kit of claim 1, wherein at least one of the first shaped form and the second shaped form includes an application region for being grasped by a user during adhesion to the breast.

11. The kit of claim 1, wherein the first shaped form comprises an asymmetric curvature profile having a first securement end for attachment above a portion of the breast, and a second securement end for attachment below and/or onto a portion of the breast.

12. The kit of claim 1, wherein the second shaped form comprises a symmetric curvature profile having a first securement end for attachment to a side of a first breast and a second securement end for attachment to a side of a second breast.

13. The kit of claim 1, wherein the top surface of at least one of the first shaped form and the second shaped form include an ornamental enhancement disposed thereon or therewith.

14. The kit of claim 1, further comprising at least one trim line disposed on a surface of at least one of the first shaped form and the second shaped form, the trim line providing an indication to a user of a trimmable size of the shaped form.

15. The kit of claim 1, further comprising at least one nipple cover configured for placement underneath at least one of the forms when formed on an individual's breast.

16. The kit of claim 1, further comprising a support layer configured for placement underneath at least one of the forms when formed on an individual's breast.

17. A breast support element for a single-use brassiere, comprising:

a shaped form for removable-adhesion to a breast to form a brassiere thereon comprising a first layer comprising an elastically deformable material having a top surface and a bottom surface, a second layer comprising an adhesive in contact with the bottom surface of the first layer, the adhesive having a first surface permanently adhered to the bottom surface of the first layer and a second surface, and a third layer comprising a removable release layer in removable contact with the second surface of the second layer, wherein the top surface of the first layer defines an overlap region demarcated thereon for indication to a user of the positioning of a second shaped form thereover.

18. The breast support element of claim 17, wherein the demarcation of the overlap region is printed on the top surface of the first layer.

19. The breast support element of claim 17, wherein the first layer is fabric-based and the adhesive of the second layer comprises an acrylic adhesive.

20. The breast support element of claim 17, wherein the shaped form comprises elastic therapeutic tape.

21. A breast support element for a single-use brassiere, comprising:

a shaped form for removable-adhesion to a breast to form a brassiere thereon comprising a first layer comprising an elastically deformable material having a top surface and a bottom surface, a second layer comprising an adhesive in contact with the bottom surface of the first layer, the adhesive having a first surface permanently adhered to the bottom surface of the first layer and a second surface, and a third layer comprising a removable release layer in removable contact with the second surface of the second layer, wherein at least one of the second layer and the third layer define a layering portion demarcated thereon for indication to a user of the positioning the shaped form at least partially over a base form.

22. The breast support element of claim 21, wherein the demarcation of the layering portion is printed on at least one of the bottom surface of the first layer and the removable release layer.

23. The breast support element of claim 21, wherein the shaped form comprises elastic therapeutic tape.

24. A kit, for the construction of a single-use brassiere, comprising:

a first shaped form for removable-adhesion to a breast comprising a first layer comprising an elastically deformable material having a top surface and a bottom surface, a second layer comprising an adhesive in contact with the bottom surface of the first layer, the adhesive having a first surface permanently adhered to the bottom surface of the first layer and a second surface, and a third layer comprising a removable release layer in removable contact with the second surface of the second layer; and a second shaped form for at least partial adhesion to the first shaped form, comprising a first layer comprising an elastically deformable material having a top surface and a bottom surface, a second layer comprising an adhesive in contact with the bottom surface of the first layer, the adhesive having a first surface permanently adhered to the bottom surface of the first layer and a second surface defining a layering portion, and a third layer comprising a removable release layer in removable contact with the second surface of the second layer;

further comprising at least one trim line disposed on a surface of at least one of the first shaped form and the second shaped form, the trim line providing an indication to a user of a trimmable size of the shaped form, and wherein at least a portion of the top surface of the first shaped form includes an overlap region for receiving a layering portion of the second shaped form thereover to form a brassiere.

* * * * *